United States Patent [19]

Saleh

[11] Patent Number: 5,025,538

[45] Date of Patent: Jun. 25, 1991

[54] APPARATUS FOR CRIMPING TOW INCLUDING STUFFER BOX, CRIMPING ROLLERS AND MOLDING ROLLERS

[75] Inventor: Lotfy L. Saleh, Charlotte, N.C.

[73] Assignee: Hoechst Celanese Corporation, Somerville, N.J.

[21] Appl. No.: 501,470

[22] Filed: Mar. 30, 1990

[51] Int. Cl.[5] ..... D02G 1/12

[52] U.S. Cl. ..... 28/263

[58] Field of Search ..... 28/263, 268, 269, 282, 28/220

[56] References Cited

U.S. PATENT DOCUMENTS

| | | | |
|---|---|---|---|
| 3,293,675 | 12/1966 | Willis | 28/268 X |
| 3,491,420 | 1/1970 | Stanley | 28/269 X |
| 3,516,241 | 6/1970 | Nakano et al. | 28/269 X |
| 3,600,776 | 8/1971 | Aoki et al. | 28/269 |
| 3,618,183 | 11/1971 | Funk et al. | 28/269 |
| 3,680,181 | 8/1972 | Heijnis | 28/269 |
| 3,835,513 | 9/1974 | Stanley | 28/268 X |
| 3,883,936 | 5/1975 | Stanley | 28/268 X |

FOREIGN PATENT DOCUMENTS

| | | | |
|---|---|---|---|
| 4428439 | 7/1972 | Japan | 28/268 |

*Primary Examiner*—Werner H. Schroeder
*Assistant Examiner*—John J. Calvert
*Attorney, Agent, or Firm*—Philip P. McCann

[57] ABSTRACT

An apparatus for crimping a continuous tow of textile material including a pair of molding rollers for initial molding and pulling of the tow, a pair of crimping rollers for molding and feeding the two to a stuffer box crimper wherein the tow is crimped. The novel pair of molding rollers includes the two spaced rotatable rollers cooperating with a side plate at each end of the nip between the rollers to define a rectangular space. Tow material is passed through the space wherein the tow is pressed and molded to the rectangular configuration. After the initial molding, the tow is passed through the pair of crimping rollers and fed into the stuffer box wherein the tow is crimped. Using the novel apparatus to crimp the tow drastically improves the uniformity of the crimped tow and the processibility or the tow. Furthermore, the novel apparatus allows for a significant reduction in the forces applied to the molding rollers and crimping rollers resulting in the reduction of filament distortion in the tow material.

11 Claims, 1 Drawing Sheet

APPARATUS FOR CRIMPING TOW INCLUDING STUFFER BOX, CRIMPING ROLLERS AND MOLDING ROLLERS

BACKGROUND OF THE INVENTION

1. Field of the Invention

The present invention relates to the preparation of crimped tow using a stuffer box in combination with a pair of crimping rollers to feed molded tow to the stuffer box and in addition to these elements, a pair of molding rollers for molding the tow before the tow enters the crimping rollers. The addition of the molding rollers not only improves the uniformity of the crimped tow, but also improves the edge quality of the tow and reduces processing runability malfunctions resulting from the sliding resistance of the crimped tow through the stuffer box. More specifically, in one embodiment, a tow of parallel filaments is molded into a rectangular cross section by a pair of parallel, rotatable molding rollers cooperating with a pair of side plates arranged to define a rectangular mold nip through which the tow is fed. In addition to molding the tow, the molding rollers pull the tow to the molding rollers and squeeze the tow to remove any residual liquid finish from the surface thereof. Subsequent to the molding rollers, the molded tow is fed through a similar rectangular nip defined by the crimping rollers. From the crimping rollers, the molded tow material is fed into a stuffer box wherein it is crimped.

2. Prior Art

In prior art apparatuses, continuous filament tow is typically pulled, dewatered, rectangularly molded and fed by a single pair of smooth, cylindrical parallel, rotatable crimping rollers in conjunction with side plates into a rectangular stuffer box, referred to in some references as a crimping chamber. The stuffer box generally forms a substantially rectangular closed pressure zone having a weighted discharge door or flapper at the exit thereof. As the tow is fed by the crimping rollers into the stuffer box, the filaments loop back and forth upon itself and against the resistance of the inner walls of the stuffer box, forming a crimped wad. This wad is compressed in its passage through the stuffer box by the friction of the side walls and the weighted discharge flapper. The action of the crimping rollers in continuously feeding tow into the chamber produces crimps in the tow which can be later effectively set by heat or fluid treatment. The crimped tow is discharged from the stuffer box at a rate proportionate to the infeed of the crimping rollers.

Each of the crimping rollers is rotatable in opposite directions and positioned along with a side plate at each end thereof to form a rectangular nip to allow the tow to be rectangularly molded between the two rollers and two side plates. By this action, the tow is pulled through the nip, and molded, conforming to the rectangular configuration of the space between the crimping rollers and side plates, as well as squeezing any hydraulic finish from the tow.

The crimping rollers are generally arranged such that one of the rollers is adjustable, for example, by a hydraulic cylinder while the other roller is fixed. For the rollers to perform all the functions of pulling, molding, dewatering and feeding the tow requires a significant force applied by the adjustable roller against the tow material. In particular, for a 250 mm tow, between 12 and 15 tons of force are applied to the adjustable roller to accomplish all the desired functions. This high force in the nip results in decreased life of the equipment parts such as the bearings and has been found to damage the tow material including damage to the filaments. One type of damage is filament distortion, for example changing the configuration of the filaments from round to oblong which is undesirable. Furthermore, it has been found that the high nip forces press the tow material against the side plates resulting in burning or fusion of the material at the side plates. This fusion results from elevated temperatures of the tow material being excessively pressured against the side plates.

Optimally crimped tow material is produced when resistance to the rectangularly molded tow by walls of the stuffer box is evenly distributed. One factor in achieving even resistance is by feeding uniformly molded tow material into the stuffer box. This requires the preceding crimping rollers to mold the tow material to have a uniform rectangular cross section. When the molded tow is nonuniform, uneven resistance occurs between the tow and the walls of the stuffer box resulting in uneven resistance to the feeding of the tow into the stuffer box. The condition induces slack in the tow entering the stuffer box further compounding the problem. Conditions resulting from the increased resistance to the incoming tow material is erratic operation of the crimping apparatus and nonuniform crimping of the tow. Hence, it is desirous for the crimping rollers to feed uniformly rectangular molded tow to the stuffer box.

In another apparatus for crimping tow, feed rollers have been installed prior to the crimping rolls for the purpose of pulling and dewatering the tow. Such feed rollers are not pressurized as the crimping rollers and provide limited molding of the tow. Although such feed rollers are known to satisfactorily perform these two functions, their use have proved unsatisfactory in improving the uniformity of the molded tow. It has been found the problem of nonuniformly molded tow is still fed from the crimping rollers to the stuffer box resulting in the resistance against such feeding as described above. Adding the additional feeding rollers has been found to result in the tow being thinned out at the lateral edges thereof which is known as doglegging. It is believed by the inventor that the thinning of the tow of the lateral edges results in loss of crimp because of the reduced contact of the lateral edges with the crimping rollers.

The following references are directed to various apparatuses used for crimping filament or fiber tow that include at least a stuffed box and crimping rollers.

U.S. Pat. No. 3,353,239 to Heijnis discloses a method and apparatus for crimping tow. Prior to entering a conventional stuffer box crimping apparatus which includes a crimping roller and stuffer box, the tow is passed through a pair of guide rollers designated 2. The improvement disclosed in this patent is with respect to the crimping rollers having ridged surfaces to better grip the tow and crimp the tow in a direction perpendicular to the crimp produced in the stuffer box. It is further disclosed that the guide rollers may also have a similar surface configuration as the crimping rollers. The use of the ridged or curved surface configuration is stated to improve the bite of the roller surfaces and favorably influence the multi-directional crimp produced in the tow. A nonuniform clearance or nip results from such surface configurations.

U.S. Pat. No. 4,004,330 to Stanley discloses a crimping apparatus for stuffer crimping a textile tow material by use of a conventional stuffer box crimper. Included in the crimper is one additional roller (17" in FIG. 7) mounted parallel and contiguous with the peripheral surface of the crimping rollers. The additional roller serves to improve the feed of the tow to the nip of the crimping rollers.

U.S. Pat. No. 4,095,318 to Abbott et al generally discloses a crimping apparatus shown in FIGS. 1 and 2 including a stuffer box, crimping rollers and feed rollers designated 16. The feed rollers and crimping rollers ar driven by the gear system 28 connected back to a motor 21.

U.S. Pat. No. 3,813,740 to Heijnis discloses a crimping apparatus for stuffer box crimping a filament or fiber tow of at least 5,000 total denier. Tow, prior to entering a conventional stuffer box crimper which includes a pair of crimping rollers and stuffer box, is passed through a series of gear wheels. These geared wheels mold the tow into a tow band having a more parallel alignment to insure uniformity and excess of crimp of the tow in a crimper housing.

European Patent Application 0 159 285 A2 to Okada discloses a crimping apparatus for stuffer box crimping a filament or fiber tow including a pair of side plates coacting with the crimping rollers to define a rectangular nip through which the tow is passed. The molded tow is then passed to an adjacent stuffer box.

Improvements disclosed in the prior art are directed to improving the feeding of the tow material to the crimping rollers, but not the rectangular molding of the tow material prior to entering the crimping rollers. These improvements are not particularly advantageous to overcome the problems of achieving uniformly crimped tow material. When additional rollers are added to pull the tow material and to dewater it, for example, improved mold uniformity of the tow material is not achieved because the crimping rollers are still totally performing the molding step. Therefore, improved feeding of the tow material to the crimper rollers does not improve the overall mold uniformity of the tow material. In fact, it has been seen that improved feeding may result in additional problems of processing the tow material.

In addition to improving the uniformity of the crimped tow material, it is desirable to improve the apparatus by reducing the applied forces to the crimper rollers. Forces of 10 to 15 tons are currently applied to crimper roller to allow the rollers to pull, dewater, mold and feed the tow. Lower forces not only reduce equipment wear, but also improves the quality of the tow material by decreasing the deformation of the filaments within the tow. Furthermore, fusion of the lateral sides of the tow is reduced.

There remains a need to develop an apparatus for stuffer box crimping which will not only improve the moldability of the tow material, but also improve the processing of the tow material, so that the overall quality of the crimped tow material is improved.

It is a further aim or aspect of the present invention to not only improve the quality of the stuffer box crimped tow material, but also produce the crimped to material being uniform nondeformed filaments by significantly reducing the forces applied to the crimper rollers.

SUMMARY OF THE INVENTION

The present invention combines a set of molding rollers which are effective in pulling, dewatering and molding tow material with a set of crimping rollers which ar effective in maintaining the molded configuration of the tow and feeding molded tow to a stuffer box. The invention uses the combination of the molding rollers and crimping rollers in a unique manner to mold and feed tow to a crimping stuffer box so as to yield not only an improvement in the quality of the crimped tow, but also in the processing of the tow. In particular, the present invention comprises a pair of molding rollers coacting with a pair of side plates to pull, dewater and mold the tow and a pair of crimping rollers coacting with another pair of side plates for maintaining the molded configuration of the tow and feeding the molded tow to a stuffer box.

In the broadest sense, the present invention comprises an apparatus for crimping a continuous tow comprising: a pair of parallel, rotatable molding rollers and a pair of side plates coacting to define a nip therebetween, and exerting pressure on said tow passing therethrough to mold said tow into a cross sectional configuration of the nip; and a pair of parallel, rotatable crimping rollers and a pair of side plates coacting to define a nip therebetween and exerting pressure on said molded tow passing therethrough to maintain the configuration of molded tow and to feed the molded tow to a stuffer box chamber for producing a crimp in said tow, said stuffer box chamber having an inlet positioned adjacent said crimping rollers and an outlet for conducting the crimped tow therethrough.

In the broadest sense, the present invention also comprises a crimped textile fibrous tow made by the above apparatus.

DESCRIPTION OF THE PREFERRED EMBODIMENT

Figure 1:
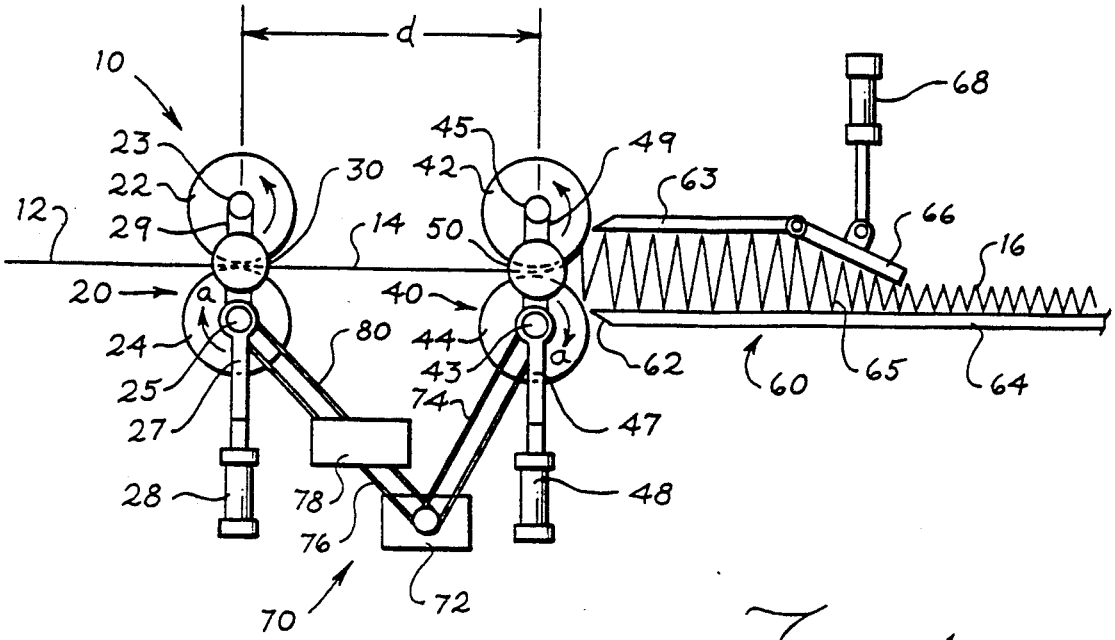
FIG. 1 is a schematic side view of the stuffer box crimping apparatus of the invention illustrating the arrangement of the tow with respect to the molding rollers, crimping rollers and stuffer box.

The principles of the present invention are particularly useful when embodied in a stuffer box crimping apparatus for crimping continuous tow as shown schematically in FIG. 1 and generally indicated by the numeral 10.

The crimping apparatus 10 is generally used to crimp a continuous tow of man-made fiber filaments, referred to herein as tow and designated as 12. Such man-made filaments include nylon and similar textile materials, such as will come readily to the mind of a person skilled in the textile arts. Prominent among suitable textile materials are polyesters (e.g. polyethylene terephthalate), the nylons (polycarbonamides), e.g., 66 nylon (i.e. polyhexamethylene adipamide), also 6-nylon, 11 nylon, 610 nylon, and fiber-forming copolymers thereof, including terpolymers. Other suitable polymeric materials for yarns or strands to be treated according to this invention include most of the thermoplastic fiber-forming materials, such as polyhydrocarbons (e.g. polyethylene, polypropylene), polyacrylonitrile and copolymers of acrylonitrile with other vinyl compounds, also copolymers of vinyl chloride and vinylidene chloride, and polyurethanes. Tow suitable for stuffer box crimping generally has a denier from about 20,000 to about 5,000,000. This list is simply exemplary and is not intended to be exhaustive of suitable compositions, most or all of which are thermoplastic.

According to this invention, thus far considered, the tow is withdrawn from a suitable source of supply, which may be heated by or between successive sets of rolls without sliding contact with a heated oiled surface and is stuffed while hot into a stuffer box crimping apparatus within which it is subjected to longitudinal compression to buckle it into crimped configuration. The entering tow usually is pulled into the roll nip and the juxtaposed apparatus entrance from along the common internal tangent thereto extended therefrom. The crimped tow is pushed and then, if the tow is not previously heated, the crimped tow goes through an oven followed by cutting into staple fibers.

The tow filaments enter the stuffing chamber at desired crimping temperature, which is dependent upon the composition, denier, processing rate, time in the chamber, etc., and often is within the range of ambient and 400° F. So long as it is under substantial crimping compression it preferably is kept under adiabatic conditions, or with addition (or subtraction) of heat such as may be required to compensate for heat loss (or frictional heating) and thereby to maintain essentially constant temperature conditions until completion of crimping.

The diagrams illustrate tow stuffer box apparatus used for treatment of multifilaments. Although many, if not all, of the suitable compositions are drawable to increased length, usually resulting in orientation of their component macromolecules longitudinally, detailed consideration of drawability of the yarns or strands being treated has been deferred in this application in the interest of orderliness and simplicity of description and illustration.

It has been customary to accomplish such orientation of drawable textile yarns or strands by a drawing process removed or unrelated in location and time (being prior, usually long prior) with respect to whatever crimping process is applied thereto to enhance their bulk, cover, hand, texture, etc. Most crimping processes tend to extend the subject yarn or strand axially while deforming it transversely of the longitudinal axis as in edge crimping, gear-crimping, jet-crimping, and twist-crimping. While there might be reason to believe that it would be feasible to perform such an extensional crimping process soon after drawing, as together with performance of one or more additional steps, the same is not true of a compressive or compressional crimping process, such as stuffer crimping. Reference is made to U.S. Pat. No. 4,004,330 which schematically illustrates and discloses a complete process used to process tow including stuffer-box crimping. It is not intended to limit the use of the present invention to such a process, but to include the description to place the present invention in a frame of reference on how it would be used in the textile industry.

Now referring to the present invention as schematically shown in FIG. 1, the crimping apparatus 10 comprises a pair of molding rollers 20 for pulling and molding the incoming tow 12 into molded tow 14, a pair of crimping rollers 40 disposed downstream of the molding rollers 20 for feeding the molded tow material to an adjacent stuffer box 60. The molding rollers 20 and crimping rollers 40 are rotated by a drive means 70 that coordinates the speeds of the two sets of rollers.

The pair of molding rollers 20 include a stationary upper roller 22 and a movable lower roller 24. It is understood these rollers could be reversed, i.e. movable upper roller and stationary lower roller. Each of the molding rollers 22, 24 are solid cylindrical members having smooth cylindrical surfaces (in some case the surfaces could be rough) and end shoulders *22a, 24a* at each end of cylindrical surfaces to form the intersection of two surfaces perpendicular to each other. Integral with each of the end shoulders *22a, 24a* and projecting outwardly perpendicular to the surface of the end shoulders *22a, 24a* are the shafts 23, 25 that may be regarded as stub shafts. Generally, each of the molding rollers 22, 24 have a diameter from about 30 mm to about 250 mm and a length from about 10 mm to about 360 mm. Preferably, the molding rollers 22, 24 have a length equal to that of the length of the crimping rollers 40. These rollers are generally made of stainless steel or steel and could have a rubber coating over the cylinder surface wherein the surface hardness of the rubber is from about 40 to about 60 shore hardness. These rollers require construction that can withstand forces up to 20 tons resulting from the pressure exerted on the rollers to mold the tow material.

The upper roller 22 is mounted on the crimping apparatus 10 to allow for driven rotation, but stationary as to lateral or vertical movement. To this end, the shafts 23 are mounted in bearings (not shown) fixedly mounted on the crimping apparatus 10. The lower roller 24 is mounted to allow for driven rotation and vertical movement to and from the upper roller 22. To this end, the shafts 25 are mounted on a carriage 27 to allow for the rotation of the roller 24. The lower roller 24 and upper roller 22 are interconnected by a drive belt 29 to drive the upper roller 22. In preferred embodiments, the lower roller 24 and upper roller 22 are driven by a universal gear box including flexible universal joints to allow for changing the spacing between the rollers 22, 24. A hydraulic cylinder 28 is affixed to the carriage 27 to enable the carriage 27 and lower roller 24 to move to and from the upper roller 22 when the hydraulic cylinder 28 is activated.

Figure 2A:
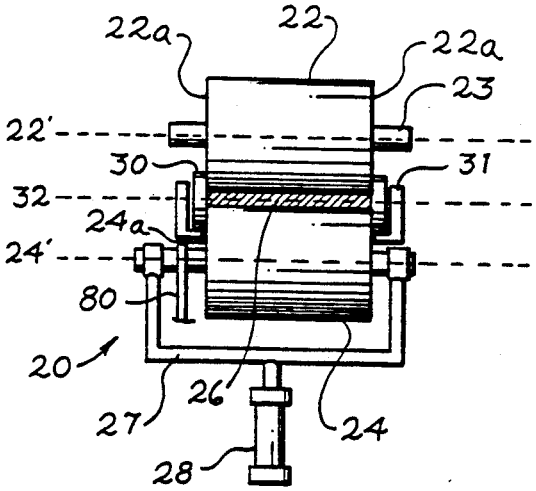
FIGS. 2A and B are schematic front views of A) the molding rollers and B) the crimping rollers illustrating the relationship of the rollers, side plates and tow nipped through the rollers.

The lower roller 24 is positioned with respect to the upper roller 22 such that the cylindrical surface of the two rollers are radially separated from each other and the cylindrical surfaces are parallel. The distance between the cylindrical surfaces of the two rollers 22, 24 forms part of a rectangular molding nip 26. Forming the ends of the rectangular molding nip 26 are two stationary disk-like side plates 30, 31, one side plate being located at each end of the rollers 22, 24 as shown in FIG. 2A. In particular, each of the side plates have flat surfaces that are held in contact with the end shoulders *22a, 24a* of the rollers 22, 24 to define the rectangular molding nip 26. To this end, the side plates 30, 31 have an aligned central axis designated 32 extending parallel to the rational axis 22', 24' of the respective rollers 22, 24. Each of the side plates 30, 31 are held in position by a suitable holder 33, 34 that maintains the side plates 30, 31 in contact with the rollers 22, 24. To avoid excessive wear of the rollers 22, 24 and the holders 33, 34, each of the side plates 30, 31 is made of a material having a hardness less than that of the rollers. In particular, it is preferred that the side plates be made of brass.

Rotary motion is transferred through the shaft 25 to the lower roller 24 by the drive means 70. As shown schematically, in FIG. 1 the drive mean 70 includes an electric motor 72 suitably connected by a drive chain 76 to a variable gear box 78 which in turn is connected by a drive chain 80 to a sprocket (not shown) mounted on the shaft 25. The lower roller 24 is rotated at a controlled speed to cause the tow to be pulled through the molding nip 26. This occurs when the tow is sandwiched between the stationary driven upper roller 22 and the driven lower roller 24. The tow 12 is drawn through a rectangular molding nip 26 defined by the rollers 22, 24 an a pair of rotatable disk-like side plates 30, 31.

With this arrangement, the tow 12 is pulled into the stuffer box crimping apparatus 10, dewatered and molded to the configuration of the rectangular molding nip 26. Pressure is exerted o the tow 12 by the action of the lower roller 24 being pressed towards the upper roller 22 wherein the rollers are rotating as indicated by arrow a in FIG. 1. The amount of pressure exerted may be from 1/10 tons to 20 tons. As the tow passes through the molding nip 26, it is pressed out against the side plates 30, 31 rubbing thereagainst. The resulting molded tow 14 has the desired rectangular configuration corresponding to that of the molding nip 26.

The pair of crimping rollers 40 of the present invention essentially contain the same elements of the pair of molding rollers 20, mounted in a similar fashion and operated in the same manner. However, the pair of crimping rollers serve a different purpose than the pair of molding rollers 20 in the present invention. The crimping rollers 40 maintain the molded configuration of the molded tow and feed the tow to the stuffer box 60.

Figure 2B:
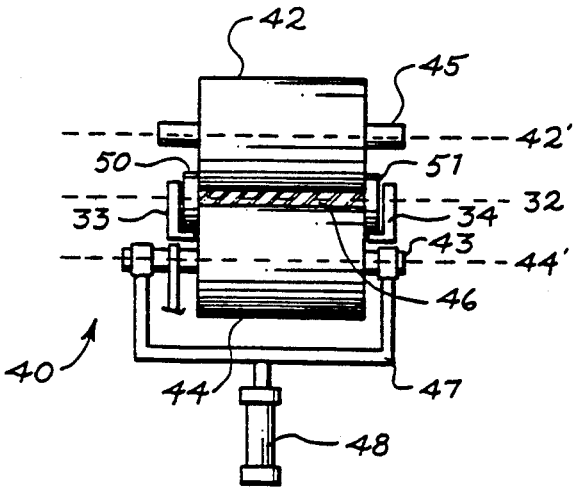

To avoid excess redundancy herein, the elements of the crimping rollers 40 will only be described in sufficient detail to allow one skilled in the art to understand the similarity of operation of the molding rollers 20 and crimping rollers 40. Reference is made to FIGS. 1 and 2B wherein the crimping rollers 40 are schematically shown in the crimping apparatus 10. To this end, the pair of crimping rollers 40 include a driven upper roller 42 and a movable lower crimping roller 44. Each of the crimping rollers 42, 44 have smooth cylindrical surfaces and end plates **42*a*, 44*a* mounted at each end of the cylindrical surfaces. Mounted on each of the end plates 42*a*, 44*a*, and projecting outwardly perpendicular therefrom are stub shafts 43, 45. The size and configuration of the crimping rollers 42, 44 are the same as the molding rollers 22, 24** described herein.

At each longitudinal end of the rollers 42, 44 is found a disk-like side plate 50, 51 that cooperate with the rollers 42, 44 to define a rectangular crimping nip 46 shown in FIG. 2B.

The stationary upper crimping roller 42 is mounted on the crimping apparatus 10 to allow for driven rotation, but stationary as to lateral or vertical movement in a fashion similar to that of the stationary upper molding roller 22. The movable lower crimping roller 44 is mounted similarly to the lower molding roller 24 to allow for driven rotation in vertical movement to and from the stationary upper roller 42. To this end, the shafts 45 of the lower roller 44 are mounted on a movable carriage 47. The lower roller 44 and upper roller 42 are interconnected by a drive belt 49 to drive the upper roller 42. A hydraulic cylinder 48 is affixed to the carriage 47 to enable the carriage 47 and lower roller 44 to move to and from the upper stationary roller 42.

The lower roller 44 is directly rotated by the drive means 70 through a drive belt 74 directly connecting the two units together. As well known in the mechanical arts, pulleys or other devices would be used on the shaft in the drive means to connect the roller and drive means together. The pair of crimping rollers are rotated at a controlled speed which may be slower than, equal to, or faster than the controlled speed of the pair of molding rollers 20. A determination as to the relationship of these speeds is based on experimental practice to obtain the optimum tension of the tow to the pair of crimping rollers 20.

As shown in FIG. 1, the molding rollers 20 and the crimping rollers 40 are horizontally separated by a distance designated d and measured from the center points of the stub shafts 23, 45. It has been found the preferred distance between the rollers is from about 5.5 inches to about 15 inches. This distance has been found to be dependent on the amount of in-process shrinkage of the tow and the stability of the tow.

The crimping rollers 40 serve to pull the incoming tow from the molding rollers 20, maintain the molded configuration of the tow material, and feed the molded tow into the stuffer box 60. As one skilled in the art would appreciate, such maintenance of the molded configuration allows for the desired uniform configuration of the tow.

The molded tow material 16 is then fed into the stuffer box 60 which includes an inlet 62 adjacent to and downstream of the crimping rollers 40, a pair of parallel spaced upper and lower plates 63, 64, a pair of parallel spaced side plates not shown in FIG. 1 but disposed on opposite sides of the upper and lower plates to define therein an elongated rectangular crimping chamber 65 for the passage of the tow 16. At the exit end of the chamber 65 is the flapper 66 hinged on one end and movable by hydraulic cylinder 68.

The molded tow 16 is fed into the stuffer box 60 by the crimping rollers 40 and pressed strongly during its advance against the inner walls of the inner surfaces of the upper and lower plates 63, 64, as well as the side plates defining the stuffer box chamber and the motion is opposed by the flapper 66. The velocity of the tow material is reduced in accordance with further advance so that the area of contact between the filaments and inner walls comes to increase. This action results in the crimp of the tow.

Trials have been conducted that compare the present invention with conventional prior art processes for crimping polyester tow material.

EXAMPLE 1

A high tensity, semi-dull, polyester 1.5 dpf, 315,000 total denier tow was processed in accordance with this invention. In particular, the tow was drawn from storage cans, heated to about 200° C. and spray coated with a suitable lubricant finish. The distance between the nip points of the molding rollers and the crimping rollers was set at 11". The size of the stuffer box was 1.5 inches wide by 1 inch high by 12 inches long. The ending crimp was 13 crimps per inch.

Once the tow of polyester filaments was crimped and heat set, the crimped tow was tested for crimped tow uniformity and edge quality. The crimped tow uniformity in a visual test wherein an inspector visually inspects the tow across its width excluding its edges to determine the variability in the crimp frequency. The resulting variability is measured on a scale of 1–5 wherein 5 represents uniform crimp frequency, that is, no variability in the number of crimps per inch. The following is a correlation between the scale and the variability in the crimp frequency:

| Scale | Crimp Variability |
|---|---|
| 5 | None - Uniform |
| 4 | About 2 CPI range of variability |
| 3 | About 4 CPI range of variability |
| 2 | About 6 CPI range of variability |
| 1 | More than 10 CPI range of variability |

In particular, the inspector looks across the width of the tow excluding the 0.25 inches of each edge. In the inspection, a determination is made as to the variance of the number of crimps per inch (CPI) from the specified CPI. For instance if the specified crimp frequency is 10 CPI, and the actual crimp frequency varies from 9 to 11 CPI, then the crimped tow uniformity would be 4.

The Edge Quality measurement is the average of measurements for 3 variables including edge snags, edge fusion and primary crimp frequency at the edges. Edge snags are broken filaments protruding out from the edge of the tow and are subjectively measured as follows:

| Scale | Edge Snags |
|---|---|
| 5 | No snags |
| 4 | Light intermittent |
| 3 | Light continuous |
| 2 | Heavy intermittent |
| 1 | Heavy continuous |

The second variable is edge fusion which is indicative of the amount of melting or lack thereof that has occurred on the tow edge due to heat buildup. Edge fusion is measured as follows:

| Scale | Edge Fusion |
|---|---|
| 5 | Primary crimp is visible |
| 4 | Light fusion, some primary crimp visible |
| 3 | Moderate fusion |
| 2 | Heavy fusion |
| 1 | Fused and Tight |

The third variable is the primary crimps at the edges. This variable is measured like the crimped tow uniformity except at the edges and based on the following scale:

| Scale | Edge Crimp Variability |
|---|---|
| 5 | None - Uniform |
| 4 | About 2 CPI range |
| 3 | About 4 CPI range |
| 2 | About 6 CPI range |
| 1 | Microcrimping |

Edge quality is determined by summing the three measurements and dividing by 3 to arrive at a value.

Experiments A and B are controls, wherein the tow material was not processed through the pair of molding rollers. The pneumatic pressure applied to the pair of crimping rollers was 55 lb/in$^2$.

In Experiment C, the tow material was processed through both the molding and crimping rollers wherein 55 lb/in$^2$ pneumatic pressure was applied to each pair of rollers.

In Experiments D-H, the pneumatic pressure to the molding rollers and crimping rollers was varied. In particular, Experiments G and H, only 10 lb/in$^2$ was applied to the molding rollers and only 35 lb/in$^2$ was applied to the crimping rollers.

TABLE 1

| | Pneumatic Pressure Molding/Crimping | Crimped Tow Uniformity | Edge Quality |
|---|---|---|---|
| Experiment A | 0/55 | 2 | 3.0 |
| Experiment B | 0/55 | 1.5 | 3.0 |
| Experiment C | 55/55 | 3.0 | 4.16 |
| Experiment D | 55/45 | 4.0 | 4.5 |
| Experiment E | 55/35 | 2.5 | 3.83 |
| Experiment F | 55/30 | 3.5 | 3.5 |
| Experiment G | 10/35 | 4.0 | 4.5 |
| Experiment H | 10/35 | 4.33 | 4.33 |

Control Experiments A and B illustrate the lower crimped tow uniformity and edge quality when compared to the improved values of Experiments C-H. In particular, the variability in the crimp frequency in control experiments A and B is more than 6 CPI and has an edge quality of 3.0. Immediate improvements in both the crimped tow uniformity and edge quality are evidenced by the data when the molding rollers are added as in Experiment C. In particular, the crimped tow uniformity improves from a variability of 6 CPI to 4 CPI and the edge quality improves to in excess of 4.0. In Experiments G and H where the pneumatic pressures have been reduced, the crimped tow variability is less than 2 CPI and the edge quality has improved to in excess of 4.3.

Thus, it is apparent that there has been provided in accordance with the invention, a crimping apparatus including a pair of molding rollers and a pair of crimping rollers in addition to the stuffer box that fully satisfies the objects, aims and advantages as set forth above. While the invention has been described in conjunction with the specific embodiments thereof and in the examples, it is evident that many alternatives, modifications and variations will be apparent to those skilled in the art, in light of the foregoing description. Accordingly, it is intended to embrace all such alternatives, modifications and variations that fall within the sphere an scope of the invention. It is not intended for the invention to be limited by the theory offered by the applicants, but only for the matter of clarification or explanation of the invention.

That which is claimed:

1. An apparatus for crimping a continuous tow of textile fibrous materials comprising a) a pair of parallel, rotatable molding rollers and a pair of side plates combined to define a molding space therebetween defining a nip and cooperating in exerting pressure on said tow at said nip passing through said molding space to mold said tow according to the molding space configuration;

b) a pair of parallel, rotatable crimping rollers and a pair of side plates combined to define a nip therebetween and located downstream of said molding rollers; and c) a stuffer box chamber for producing a crimp in said tow and having an inlet positioned downstream and adjacent said crimping rollers and an outlet for conducting the crimped tow therethrough.

2. An apparatus of claim 1, wherein the molding space as defined by the pair of molding rollers and said pair of side plates is substantially of the same size and configuration of the crimping space as defined by the pair of crimping rollers and said pair of side plates.

3. An apparatus of claim 2, wherein the molding space and crimping space have a rectangular configuration.

4. An apparatus of claim 1, wherein the pair of molding rollers and the pair of crimping rollers are separated by a distance from about 5.5 inches to about 15 inches as measured from the center points of upper molding roller and upper crimping roller.

5. An apparatus of claim 1, wherein the pair of molding rollers comprises an upper roller and a lower roller, each roller having a smooth cylindrical surface and the pair of crimping rollers comprises an upper roller and a lower roller, each roller having a smooth cylindrical surface.

6. An apparatus for crimping a continuous tow of textile fibrous materials comprising a) a pair of parallel, rotatable driven molding rollers and a pair of side plates combined to define a molding space therebetween defining a nip and cooperating in exerting pressure on said textile fibrous materials at said nip passing through said molding space to mold said tow according to the configuration of the molding space;

b) a pair of parallel, rotatable crimping rollers, and a pair of side plates combined to define a crimping space therebetween and located downstream of said pair of molding rollers;

c) a means to rotate at least one of said pairs of molding rollers and at least one of said pair of crimping rollers; and d) a stuffer box chamber for producing a crimp in said tow having an inlet positioned downstream adjacent said crimping roller and an outlet for conducting the crimped tow therethrough.

7. An apparatus of claim 6, wherein the molding space as defined by the pair of molding rollers and said pair of side plates is substantially of the same size and configuration of the crimping space as defined by the pair of crimping rollers and said pair of side plates.

8. An apparatus of claim 7, wherein the molding space and crimping space have a rectangular configuration.

9. An apparatus of claim 6, wherein the pair of molding rollers and the pair of crimping rollers are separated by a distance from about 5.5 inches to about 15 inches so measured from the center points of upper molding roller and upper crimping roller.

10. An apparatus of claim 6 wherein said means to rotate at least one of said pairs of molding rollers and at least one of said pairs of crimping rollers comprises an electric motor connected by a drive chain to said crimping rollers and connected to said roller of the pair of molding rollers through a variable gear box.

11. A method of crimping a tow of continuous filaments having a substantial uniform cross-section configuration for the purposes of improving the processability of the tow material and obtaining a uniform crimp, comprising the steps of:

a) passing said tow of continuous filaments through a means to mold said tow having a defined space through which the tow passe and is molded to the configuration of said defined space;

b) continuously directing said molded tow to pass from said means to mold the tow into a crimping means having a defined space substantially similar to said defined space of said molding means wherein said crimping means exerts pressure on the tow to maintain the configuration of the molded tow;

c) continuously feeding said molded tow into a stuffer box and maintaining the molded tow therein for a time sufficient to impart a crimp therein; and d) removing the crimped tow from said stuffer box.

* * * * *